United States Patent [19]

Zängerle

[11] Patent Number: 4,476,702

[45] Date of Patent: Oct. 16, 1984

[54] APPARATUS FOR MEASURING AND REGULATING THE POSITION OF A WIRE END OF A SPIRAL SPRING IN A COILING MACHINE

[75] Inventor: Ernst Zängerle, St. Gallen, Switzerland

[73] Assignee: Spuhl AG, St. Gallen, Switzerland

[21] Appl. No.: 470,668

[22] Filed: Feb. 28, 1983

[30] Foreign Application Priority Data

Apr. 6, 1982 [DE] Fed. Rep. of Germany ..... 3212797

[51] Int. Cl.[3] ..... B21C 51/00; B21F 3/10; B21F 35/02

[52] U.S. Cl. ..... 72/15; 72/34; 72/137; 72/138; 140/103

[58] Field of Search ..... 72/11, 12, 15, 31, 32, 72/34, 135, 137, 138, 139; 140/92.7, 103

[56] References Cited

U.S. PATENT DOCUMENTS 4,111,241 9/1978 Crown ..... 140/92.7

FOREIGN PATENT DOCUMENTS 1073995 1/1960 Fed. Rep. of Germany .
1170359 5/1964 Fed. Rep. of Germany .
583080 1/1925 France ..... 72/138
476065 7/1975 U.S.S.R. ..... 72/137
478657 7/1975 U.S.S.R. ..... 72/137

*Primary Examiner*—E. Michael Combs
*Attorney, Agent, or Firm*—Sughrue, Mion, Zinn, Macpeak and Seas

[57] ABSTRACT

A machine for producing spiral springs whose ends are twisted around the adjacent coils includes inductive proximity switches 18, 19 for sensing the position of the wire end 3*a* of each spring 3 conveyed from a coil forming station A. The measurement results are fed to a preselector counter 21, and when deviations from the correct wire length exceed a certain predetermined number a regulating motor 23 adjusts a tool which determines the coil diameter of the spring.

2 Claims, 4 Drawing Figures

APPARATUS FOR MEASURING AND REGULATING THE POSITION OF A WIRE END OF A SPIRAL SPRING IN A COILING MACHINE

BACKGROUND OF THE INVENTION

The invention relates to an apparatus for measuring and regulating the position of a wire end of a spiral spring in a coiling machine.

A machine for producing double-coned spiral springs having twisted ends for use in bed mattresses and sofa upholstery is disclosed in German Pat. No. 2,073,995. This machine is equipped with a step-advanced rotatable turret having several radially positioned gripping arms which transport the produced spiral springs from one stage of production to the next. At the first production station a spiral spring is coiled from a severed length of wire. At the following two stations both of the wire ends of the spring are twisted around their adjacent end coils to form closed circles.

Inconsistencies or non-uniformities in the lead wire characteristics result in dimensional fluctuations in the springs which are produced. Since the length of the wire is actually not affected by these inconsistencies, the primary effects are deviations in the position of the wire end of the wound spring. Deviations in the position of the wire end which are too great result in incorrect twists in the succeeding twisting operation, as performed by an apparatus of the type described in German Pat. No. 1,170,359.

Until now, a service person on the machine had to monitor the twising operation and make manual adjustments to the tool which determines the diameter of the spring coil, to thereby compensate for inconsistent deviations in the position of the wire end. In the case of poorer and hence cheaper qualities of wire, these adjustments required the major attention of the machine monitor, and were often barely able to be controlled. May disturbances were thus created which jeopardized economic production. Hence, the effectiveness of the machine was dependent on the competency of the operator and the quality of the wire.

SUMMARY OF THE INVENTION

It is an object of this invention to provide an apparatus for a spring coiling machine which automatically monitors or measures the position of the wire end of a coiled spring, and which in response to such measurements makes the necessary adjustments on the setting of the tool which determines the diameter of the spring coil.

DETAILED DESCRIPTION OF THE PREFERRED EMBODIMENT

Figure 1:
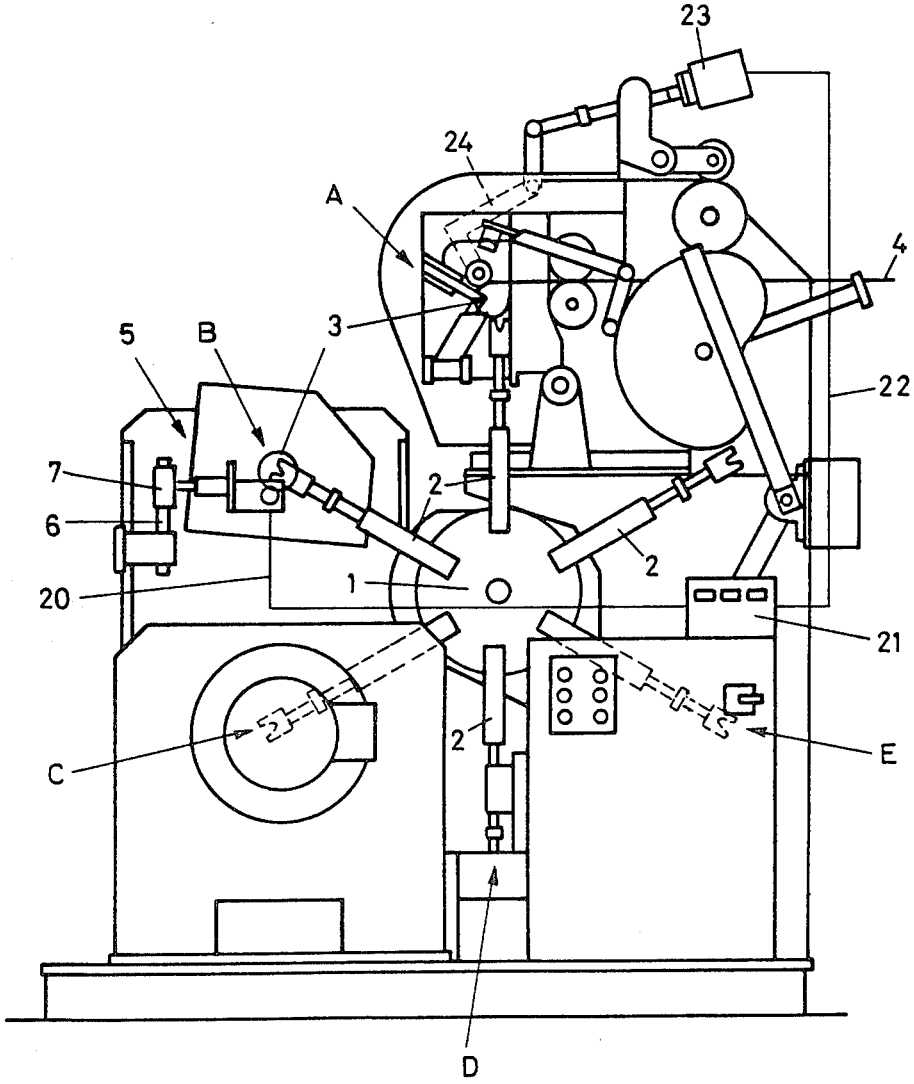
FIG. 1 shows a side view of a machine according to the invention for producing spiral springs with both ends twisted, including a device for regulating the position of the wire end before twisting.

The machine shown in FIG. 1 for producing spiral springs whose ends are twisted around the adjacent coils is substantially similar to that disclosed in German Pat. No. 1,073,995. Its structure and function will thus be described herein only to the extent necessary for a full understanding of this invention. The machine is designed with an intermittently driven or step indexed rotating turret having six radial gripping arms 2 which serve to transport the spiral springs 3 being fabricated through five stages of production A, B, C, D and E.

In production station A a wire 4 is fed in from a supply roll (not shown) to a coiling and cutting mechanism. A gripping arm 2 then leads the coiled spring 3 to station B whereat the rear wire end, facing outwardly in FIG. 1, is twisted around the adjacent coil by a known apparatus as described in German Pat. No. 1,170,359. Station B includes a measuring device 5 according to the invention, which is described in detail below.

The second spring end is similarly twisted around its adjacent coil to "close the circle" at station C, station D is an annealing device for the coiled and twisted spring, and at station E the finished spiral springs are transferred to a stocking device.

Figure 2:
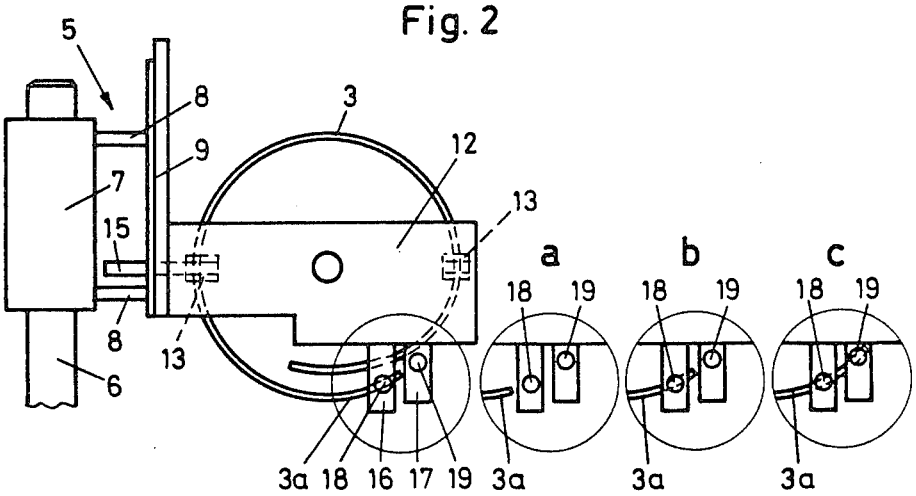
FIG. 2 shows a top view of the measuring device of the invention, on an enlarged scale, with the presentation of three possible measurements.
Figure 3:
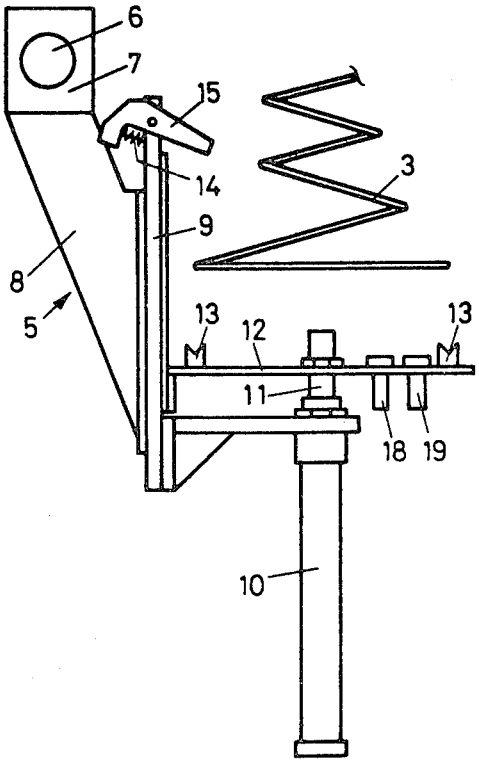
FIG. 3 shows a side view of the measuring device of FIG. 2 before the onset of measuring.
Figure 4:
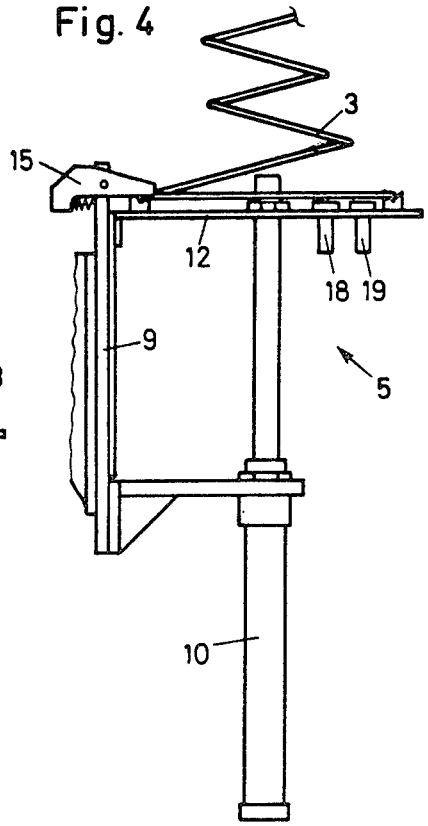
FIG. 4 shows a side view according to FIG. 3 during measuring.

In FIGS. 2, 3 and 4 the measuring device 5 is shown on a larger scale. An adjustable clamp 7 is attached to rod 6 which is securely connected to the overall machine base. Two brackets 8 are attached to the clamp, and mount a guide plate 9, which carries a pneumatic or hydraulic cylinder 10 whose piston rod 11 is secured to a stop plate 12. The stop plate is movable by the rod 11 parallel to the guide plate 9 and in the axial direction of the spring 3, which is held in the position shown in FIG. 3 by a gripping arm 2. A pair of spaced and notched centering blocks 13 are attached to the stop plate 12, and a pivot stop 15 under tension from a spring 14 is mounted on the upper end of the guide plate. When the stop plate 12 is moved against the spring 3 by extending the piston rod 11, then as illustrated in FIG. 4, the final coil of the spring is engaged by the centering blocks and clamped by the pivot stop 15.

Two carrier plates 16 and 17 are attached to and extend downwardly from the stop plate 12. A pair of inductive proximity switches 18, 19, for example of the type manufactured by Balluff, are attached to the respective carrier plates. These switches are positioned such that they are both overlaid by the wire end **3*a* of the final coil of the spring 3 if this wire end is a bit too long. In FIG. 2 the three possible positions of the wire end are shown in the partial figures a, b and c. Partial figure a shows a wire end 3*a*** which is too short; partial figure b shows a wire end having a correct or desired length; partial figure c shows a wire end which is too long.

The sensing and regulating apparatus works in the following manner: for each spring 3 the measuring device 5 senses the position of the wire end **3*a* at production station B. The switches 18, 19 convey their respective output measurements via conductors 20 (FIG. 1) to a preselector counter 21 having three meters. One meter continuously counts, for example, up to 100 springs. The second meter counts the "too short" signals from these 100 springs, and the third meter counts the "too long" signals. The second and third meters are set, for example, on the preselection number 70. If the counts of the second or third meter surpass the number 70, a regulating motor 23 is activated via a time-relay mechanism and a conductor 22 which serves to adjust the tool which controls the coil diameter of the springs to be twisted and hence the position of the wire end. Thus, if incorrect wire end lengths occur in more than a predetermined number of springs 3**, an immediate adjustment is automatically made by the regulating apparatus of the invention.

What is claimed is:

1. An apparatus for measuring and regulating the position of a wire end of a spiral spring before twisting said end around an adjacent spring coil, said apparatus being associated with a machine for producing spiral springs including a coil forming station, two twisting stations, and an outlet station, and a transport device having gripping arms for conveying the coiled springs in succession to the different stations, characterized by: a reciprocable stop plate (12) mounted at a twisting station (B) in axial alignment with a coiled spring (3) at said station, said stop plate being operable to clamp an end coil of the spring against a stop member (15), a pair of inductive proximity switches (18, 19) attached to the stop plate for sensing the position of a wire end (3*a*) of said end coil and for conveying one of three possible output measurements to a counter (21), and a regulating motor (23) responsive to the counter for adjusting a tool in the coil forming station which determines the diameter of the spring.

2. An apparatus according to claim 1, wherein the stop plate has spaced centering blocks (13) for stabilizing the end coil of the spring, wherein the stop plate is slidably reciprocated against the stop member by a piston and cylinder unit (10, 11), and wherein the stop member is pivotally mounted and under spring tension.

* * * * *